United States Patent [19]

Ditchburn et al.

[11] Patent Number: 4,946,045

[45] Date of Patent: Aug. 7, 1990

[54] SORTING

[76] Inventors: Robert W. Ditchburn, 9 Summerfield Rise, Goring-on-Thames, Reading, Berkshire RG8 ODS; Martin P. Gouch, 211 Cranbury Road, Reading, Berkshire, both of Great Britain

[21] Appl. No.: 214,465

[22] Filed: Jul. 1, 1988

Related U.S. Application Data

[63] Continuation of Ser. No. 943,128, Dec. 18, 1986, abandoned.

[30] Foreign Application Priority Data

Dec. 20, 1985 [GB] United Kingdom ..... 8531396

[51] Int. Cl.[5] ..... B07C 5/342

[52] U.S. Cl. ..... 209/576; 209/586

[58] Field of Search ..... 209/586, 587, 588, 598, 209/939, 576, 577

[56] References Cited

U.S. PATENT DOCUMENTS

| | | | |
|---|---|---|---|
| 3,035,480 | 5/1962 | Teucher | 209/586 |
| 3,549,008 | 12/1970 | Anderson | 209/586 |
| 3,858,979 | 1/1975 | Elbe | 356/30 |
| 3,867,032 | 2/1975 | Bruck | 356/30 |
| 4,205,973 | 11/1978 | Ryan | 65/29 |
| 4,324,335 | 4/1982 | Conway et al. | 209/586 |
| 4,493,420 | 1/1985 | Dennis | 209/587 |
| 4,624,367 | 11/1986 | Shafer et al. | 209/586 |
| 4,666,045 | 5/1987 | Gillespie et al. | 209/586 |

FOREIGN PATENT DOCUMENTS

| | | | |
|---|---|---|---|
| 0105452 | 2/1984 | European Pat. Off. | 209/586 |
| 2726162 | 12/1977 | Fed. Rep. of Germany . | |
| 53197 | 10/1977 | Israel . | |
| WO87/01974 | 4/1987 | PCT Int'l Appl. . | |
| WO87/01975 | 4/1987 | PCT Int'l Appl. . | |
| 715619 | 9/1954 | United Kingdom . | |
| 853978 | 11/1960 | United Kingdom . | |
| 1143541 | 2/1969 | United Kingdom . | |
| 1167787 | 10/1969 | United Kingdom . | |
| 1449656 | 3/1974 | United Kingdom . | |
| 1416568 | 12/1975 | United Kingdom . | |
| 1571889 | 3/1977 | United Kingdom . | |
| 1571890 | 3/1977 | United Kingdom . | |
| 2022824 | 12/1979 | United Kingdom . | |
| 2030286 | 4/1980 | United Kingdom . | |
| 2037980 | 7/1980 | United Kingdom . | |
| 2067753 | 7/1981 | United Kingdom . | |
| 2067924 | 8/1981 | United Kingdom . | |
| 2080712 | 2/1982 | United Kingdom . | |
| 2081439 | 2/1982 | United Kingdom . | |
| 2142426A | 1/1985 | United Kingdom . | |

OTHER PUBLICATIONS

"Systems, Computers, Control", vol. 8, No. 3, May--Jun. 1977, pp. 18–20 (Kikuchi & Tzuji article).

Zeitschrift für Kristallographie, vol. LXV (1927), pp. 46–48, article by Siegfried Rösch entitled, "Beitrag zum Brillanzproblem".

Piermatic MKIII Polishing Machine Training Manual.

*Primary Examiner*—Joseph F. Peters, Jr.

*Assistant Examiner*—Edwin J. Swinehart

*Attorney, Agent, or Firm*—Kerkam, Stowell, Kondracki & Clarke

[57] ABSTRACT

A rapid succession of objects such as sweets are sorted according to shape by being fed through a viewing zone, flash illuminated in the viewing zone, and viewed by a number of fixed electronic viewers spaced in one plane around the viewing zone through just under 180°, the edges of the images produced by the viewers being examined for approximation to a spherical shape, approximation to symmetry and reentrants, and one of a number of air jet nozzles being thereby automatically energised to direct the object into an appropriate bin.

34 Claims, 4 Drawing Sheets

SORTING

This is a Continuation of Application Ser. No. 943,128, filed Dec. 18,1986 now abandoned.

BACKGROUND TO THE INVENTION

The present invention relates to a method of and apparatus for sorting a succession of objects according to shape, including feeding each successive object through a viewing zone and eliminating the object as it passes through the viewing zone, thereafter directing the object into one of at least two paths according to its shape. The objects may be for instance edible products such as peas or sweets, but the invention is in no way limited to edible products.

The general intention of the inventin is to automate the shape sorting of the objects.

SUMMARY OF THE INVENTION

According to the invention, each successive object is viewed as it passes through the viewing zone using at least four fixed electronic viewers spaced in one plane around the viewing zone and normally at 90° to the direction of feed of the object, signals being derived from each viewer representative of the edges of the object as viewed at a particular instant by the viewers, the signals being processed electronically to determine in which of at least two shape categories the object falls, and the object being automatically directed into one of at least two paths according to its shape.

Using the invention, good sorting can be obtained. However, it is normally difficult to have a positive sort into acceptables and rejects and one solution is to provide at least three shape categories, namely acceptables, hand-sorts and rejects, the hand-sort category being necessary if the apparatus is unable to discriminate sufficiently; this is acceptable in practice if the percentage of hand-sorts is reasonably low.

BRIEF DESCRIPTION OF THE DRAWINGS

The invention will be further described, by way of example, with reference to the accompanying drawings, in which.

DESCRIPTION OF PREFERRED EMBODIMENT

Figure 1:
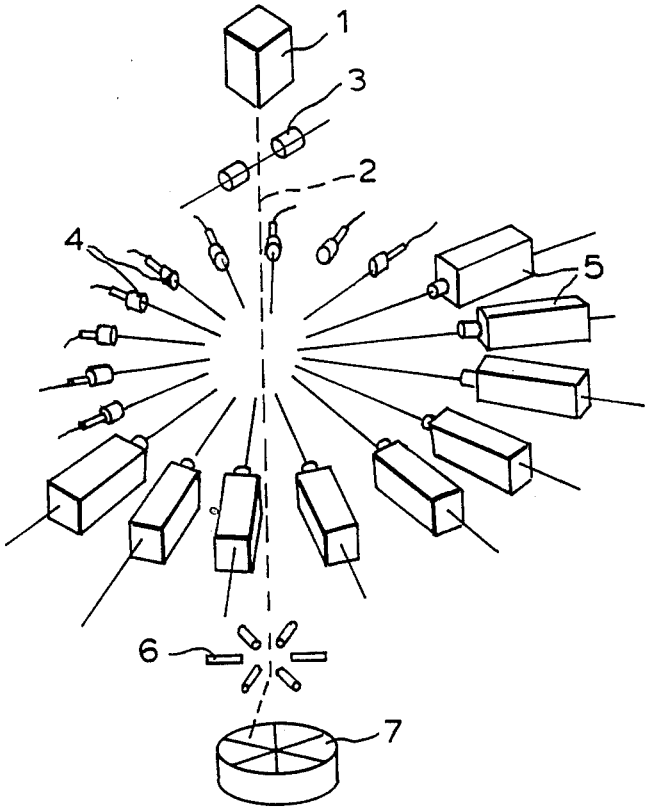
FIG. 1 is a schematic, isometric view of apparatus in accordance with the invention.

FIG. 1 shows a suitable feeder 1 which feeds the objects one by one vertically downwards in rapid succession. The feeder 1 is just shown schematically as suitable feeders are available. The objects should be fed at at least one per second, and preferably more than five per second or ten per second, say twelve per second. The objects are accelerated within the feeder 1, and leave the feeder at a speed of say 1 m/s or preferably 2 m/s. The objects should be unrestrained as they pass through the viewing zone so that the images of the objects are not obscured by any mechanical parts, and thus the objects will be in free flight. Vertical fall is the simplest to arrange, but in theory at least the objects could be projected for instance horizontally through a viewing zone. The path 2 of the objects is indicated. The objects pass through a light curtain 3 which signals their arrival at the shape sorting zone. The light curtain 3 triggers a strobe unit formed by seven illuminators 4. Preferably, the illuminators receive white light from a laser flashlight (flash lamp) by way of fibre optics, and have a lens for forming parallel light. The light can have any suitable wavelength. The length of flash depends upon the speed of the objects, but for a speed of just over 1 m/s, the length can be 15 microseconds.

Diametrically opposite each illuminator 4 there is an electronic viewer 5, the viewers 5 being spaced in one plane around a viewing zone, which plane is at 90° to the direction of feed or path 2 of the objects. In the machine illustrated, there are nine viewers 5, but it may be possible to have as few as four or more suitably five in order to obtain a sensibly efficient sort; seven viewers 5 would be a practical possibility. The angular separation of the profiles which are examined depends on the number of viewers 5. It will be seen that the viewers are spaced through somewhat under 180°, the angular distance between each viewer 5 being 180° divided by the number of viewers 5. The viewers 5 are each directed at an illuminator 4, so that a silhouette of the object is generated and the image received is of a dark object against a light field-this gives better resolution and a greater depth of focus. Each viewer 5 views the whole of the profile (i.e., periphery or outline) of the object as presented to the view 5. No viewer is needed from above in view of the arrangement of the viewers 5.

After dropping below the plane of the viewers 5 and illuminators 4, the objects pass through a sorting device comprising a ring of a suitable number of air jet nozzles 6 which direct successive objects into one of a number of paths according to their shapes. The nozzles 6 can be connected to compressed air via solenoid valves (not shown). There are shown a number of bins 7 corresponding to the number of nozzles 6, but there could be a central bin as well. The number of nozzles 6 and bins 7 will depend on the types of categories required for the sort. For instance, six bins 7 are required for the decision tree shown in FIG. 3, which is specifically for sorting diamonds having a maximum weight of 4 carat and and a minimum weight of 1/15 carat, with less than 30% for hand sorting—the acceptables are sawables and the rejects makeables (the latter may need hand sorting to decide if they should be cleaved). The intention is to sort the two "low confidence" bins.

Figure 2:
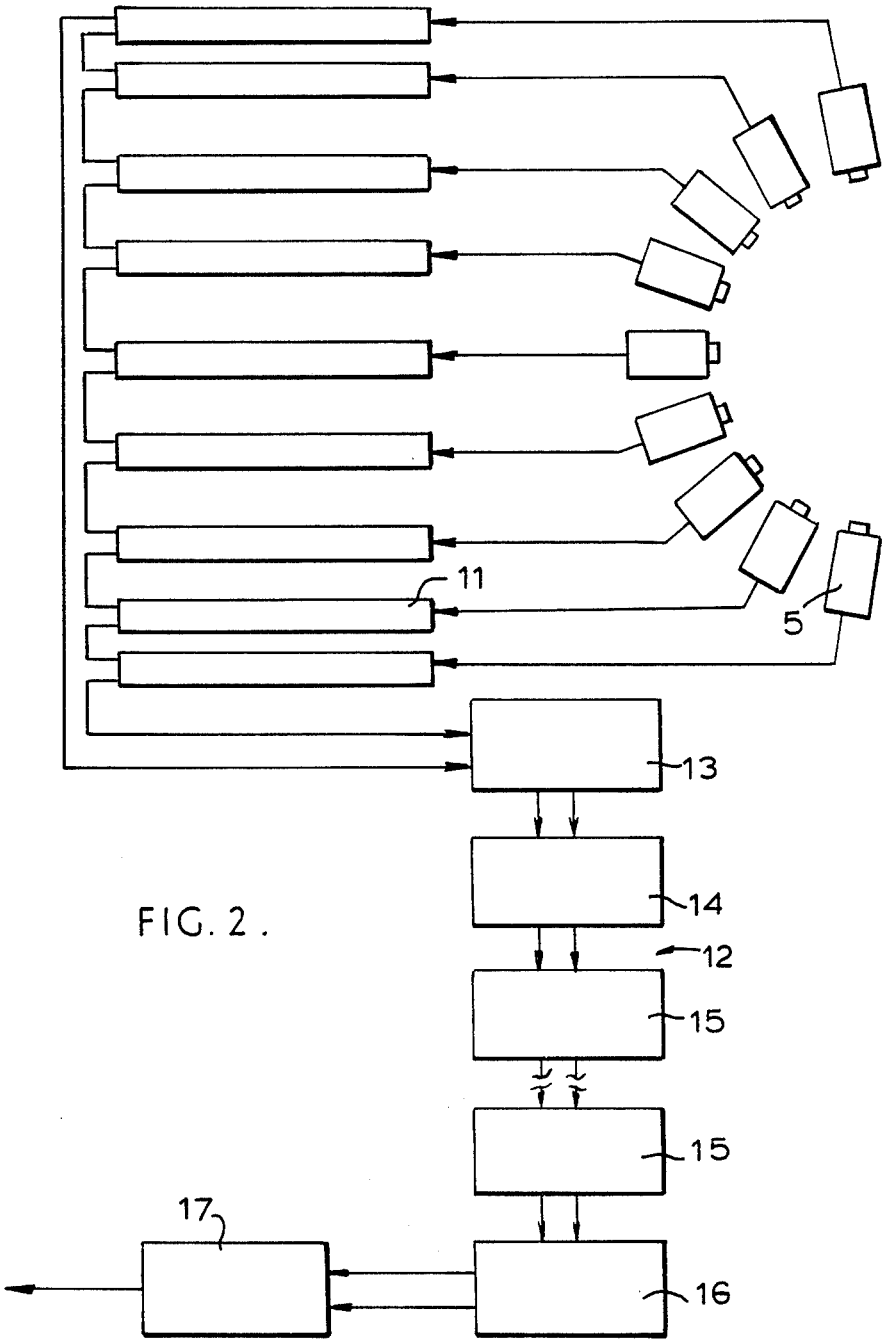
FIG. 2 is a block diagram of the electronics of the apparatus.

As shown in FIG. 2, each viewer 5 is connected to a channel capture board 11 which normalises (white made true white, black made true black) by selecting a voltage threshold between black and white, and digitises the signal, thereby providing digital (video data) signals representative of the edges of the object as viewed by the viewer 5, and tracks round the edge or boundary. The data signals are then fed to a computer 12.

The computer 12 incorporates a channel scanner 13 which scans each channel (from each viewer 5) in turn, a general purpose function card 14, a number of special function cards 15, a memory 16 and a head processor 17. The head processor 17 controls the admission of compressed air to the nozzles 6, to open one of the valves. In the arrangement illustrated, separate function cards 14, 15 are used, and these are hand wired. Apart from the general purpose function card 14, each card is specifically for one function. It would be possible to programme these functions using normal software, but the function cards are preferred. The function cards can be changed, for instance if a large amount of objects having a certain peculiarity must be sorted. The general purpose function card 14 is programmable, so that it can be programmed for any modifications; it runs more slowly than the cards 15 but is more flexible.

Figure 3:
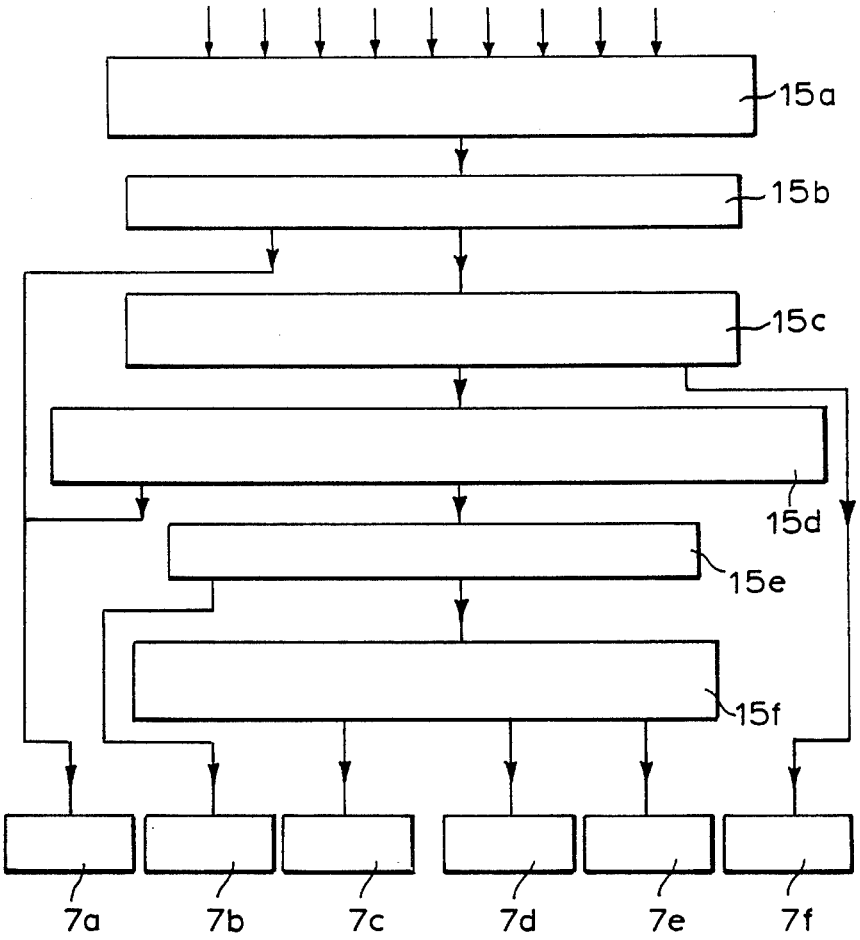
FIG. 3 is a block diagram of the decision tree of the apparatus.

The decision tree is shown in FIG. 3. The general function card 14 is not represented. For each decision, the average value of the parameter (sphericity, symmetry and convex hull deviance) is determined for all the channels, i.e. views, before combining the parameters (if required) and making the decision.

Figure 4:
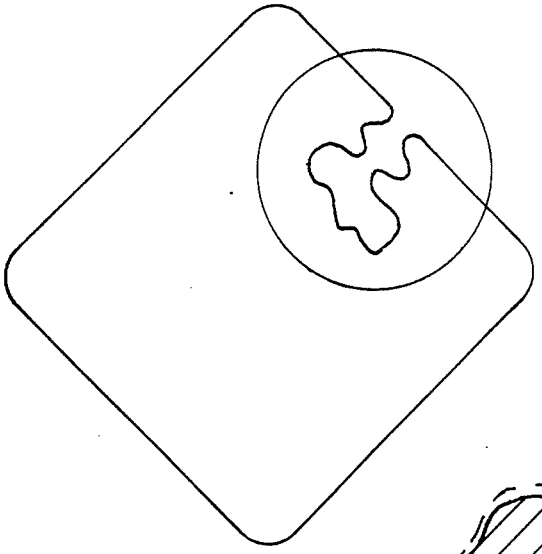
FIGS. 4 to 7 represent the functions carried out in the function cards shown in FIG. 2.

At 15*a*, a signal is derived representative of any optical edge breakthrough, and edges are joined on either side of the breakthrough. Edge breakthrough occurs when the objects are translucent or transparent, caused by refraction or internal reflection. There is a highly irregular reentrant, represented schematically in FIG. 4. The edge (boundary) is traced and the rate of changge in direction of each incremental length of the edge (boundary) is determined. The rate of change of direction in a normal reentrant is much lower than in a breakthrough. The beginning and end of the zone of large rates of change of direction are determined, and are electronially joined up. If desired, the shorest distance between the beginning and end can be determined—if this is low (say less than 1% of the total edge length as detected), breakthrough is present. Another possibility is to determine the length of the detected edge between the beginning and end of the high frequence profile and compare it to the length of the remainder of the edge—if the high frequency length is great, breakthrough is present.

Figure 5:
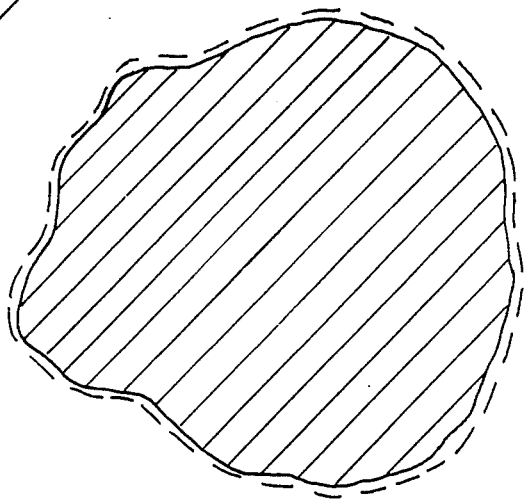
Figure 6:
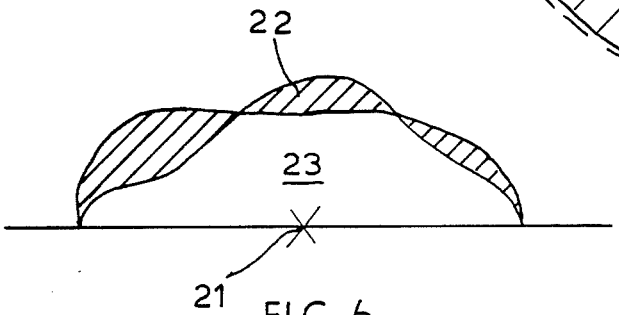

At 15*b*, signals are derived representative of the approximation of the object to a spherical shape (blockiness) and representative of the approximation of the object to symmetry, as illustrated in FIGS. 5 and 6. In order to determine the blockiness, the area of the image is determined and the area is divided by the square of the length of the edge. In order to determine the symmetry, the centroid 21 is determined, the image is divided into two parts along a line passing through the centroid 21, one part is rotated about 180° to superimpose it on the other part, and the mismatch area 22 is compared with the overlapped area 23. The line passing through the centroid 21 may be taken as the horizontal line, thus determining whether there is symmetry about a horizontal plane for that particular channel or view; only one line through the centroid 21 is needed due to the 180° rotation, in order to obtain a good approximation to a determination of axial symmetry about the centroid. The signals representative of blockiness and symmetry are added. Objects having low values are directed to bin *7a* (high confidence rejects).

Figure 7:
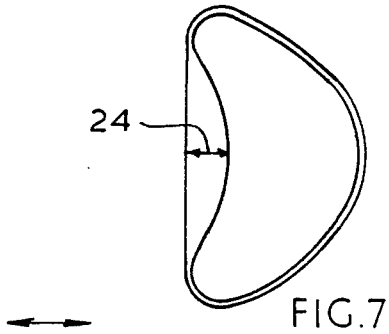

At 15*c*, the sphericity and symmetry are again determined, and also a signal is derived representative of reentrants in the image. The latter signal can be determined by determining the convex hull deviance, i.e. the difference between the length of the edge and the length of the line which extends around the edge but extends, like an elastic band would, straight across any reentrant 24 (see FIG. 7). In more detail, a line of polygonal (say hexagonal) shape is placed around the image and is then shrunk on to the edge of the image by not being permitted to go within the minimum distance between any two points. The signals of blockiness, symmetry and inverse convex hull deviance are combined, and objects having a high value are directed to bin *7f* (high confidence acceptables).

At 15*d*, the inverse convex hull deviance is combined with the standard deviation of blockiness and symmetry. Objects having a low value are directed to bin *7a* (high confidence rejects).

At 15*e*, the overall blockiness and symmetry signals are again combined, and low values are directed towards bin *7b* (medium confidence rejects).

At 15*f*, the signals of overall blockiness, symmetry and inverse convex hull deviance are combined. Low values are directed to bin *7c* (low confidence rejects), high values are directed to bin *7e* (medium confidence acceptables) and the remainder are directed to bin *7d* (low confidence acceptables). It will be appreciated that the limiting values in 15*b* and 15*e* are different, as are the limiting values in 15*c* and 15*f*, thus changing the confidence of the sort.

As an alternative to the electronic viewers 5, it would be possible to use strobed area sensors.

We claim:

1. A method of sorting a succession of objects according to shape, comprising:

feeding each successive object through a feeding zone at a rate of at least one per second;

illuminating the object as it passes thruogh the viewing zone;

viewing the object as it passes through the viewing zone using at least four fixed electronic viewers spaced in one plane around the viewing zone, each viewer viewing substantially the whole of the profile of the object as presented to the viewer;

deriving from each viewer signals representative of substantially the whole of the profile of the object as viewed at a particular instant by each respective viewer;

processing the signals electronically to determine in which of at least two shape categories the object falls; and automatically directing the object into one of at least two paths according to its shape.

2. The method of claim 1, wherein processing the signals electronically includes the step of deriving a signal representative of any optical edge breakthrough at the profile of the object and joining up edges on either side of the breakthrough.

3. The method of claim 2, wherein the edge breakthrough signal is derived by determining the rate of change in direction of each incremental length of the edge and categorising a zone of large rates of change in direction as an edge breakthrough.

4. The method of claim 1, wherein processing the signals electronically includes the step of deriving a signal representative of the approximation of the object to a spherical shape.

5. The method of claim 4, wherein the spherical shape signal is derived by determining the area of the image and dividing the area by the square of the perimeter of the image.

6. The method of claim 1, wherein processing the signals electronically includes the step of deriving a signal representative of the approximation of the object to symmetry.

7. The method of claim 6, wherein the symmetry signal is derived by determining the centroid of the image, dividing the image into two parts along the line passing through the centroid, rotating one part about 180° to superimpose it on the other part, and comparing the mismatch area with the overlapped area.

8. The method of claim 1, wherein processing the signals electronically includes the step of deriving a signal representative of reentrants in the image.

9. The method of claim 8, wherein the reentrant signal is derived by determining the difference between the length of the profile and the length of the line which extends around the profile but extends straight across any reentrant.

10. The method of claim 1, wherein the viewers are equi-spaced through less than 180°, the angular distance between adjacent viewers being 180° divided by the number of viewers.

11. The method of claim 1, wherein each viewer is connected to means which normalises and digitises the signal from the viewer, thereby providing digital signals representative of the edges of the object as viewed by the viewer.

12. The method of claim 11, wherein digital signals representative of the profile are obtained by tracking round the profile of each respective object.

13. A method of sorting a succession of objects according to shape, comprising:

feeding each successive object through a feeding zone at a rate of at least one per second;

illuminating the object as it passes through the viewing zone;

viewing the object as it passes through the viewing zone using at least four fixed electronic viewers spaced in one plane around the viewing zone, each viewer viewing substantially the whole of the profile of the object as presented to the viewer;

deriving from each viewer signals representative of substantially the whole of the profile of the object as viewed at a particular instant by all the viewers;

processing the signals electronically to determine in which of at least two shape categories the object falls, including deriving a signal representative of the approximation of the object to a spherical shape, deriving a signal representative of the approximation of the object to symmetry, and deriving a signal representative of reentrants in the object; and automatically directing the object into one of at least two paths according to its shape.

14. The method of claim 13, and including the steps of:

executing a high confidence sort on the basis of combined spherical and symmetry signals and rejecting values below a low threshold;

executing a high confidence sort on the basis of combined spherical, symmetry and inverse reentrant signals and accepting values above a high thresold;

executing a high confidence sort on the bais of an inverse reentrant signal combined with combined standard deviation spherical and symmetry signals, and rejecting values below a low threshold;

executing a medium confidence sort on the basis of combined spherical and symmetry signals and rejecting values below a medium threshold;

executing a low or medium confidence sort on the basis of combined spherical, symmetry and inverse reentrant signals, rejecting values below a high threshold, and accepting values above a medium threshold.

15. Apparatus for sorting a rapid succession of objects according to shape, comprising:

a viewing zone through which each successive object will be fed;

means for illuminating the object as it passes through the viewing zone;

at least four fixed electronic viewers spaced in one plane around the viewing zone, for viewing substantially the whole of the profile of the object as presented to the individual viewers, as it passes through the viewing zone;

means for deriving from each viewer signals representative of substantially the whole of the profile of the object as viewed at a particular instant by all the viewers;

sorting means for directing the object into one of at least two paths; and electronic processing means for processing said signals to determine in which of at least two shape categories the object falls, and for giving output signals to said sorting means for automatically directing the object into one of said at least two paths according to the shape of the object.

16. Apparatus for sorting a succession of objects according to shape, comprising:

a viewing zone through which each successive object will be fed;

means for illuminating the object as it passes through the viewing zone;

at least four fixed electronic viewers spaced in one plane around the viewing zone, for viewing substantially the whole of the profile of the object as presented to the respective viewers, as it passes through the viewing zone;

means for deriving from each viewer signals representative of substantially the entire profile of the object as viewed at a particlular instant by each respective viewer; and electronic processing means for processing the signals to determine in which of at least two shape categories the object falls, and for giving output signals which can be used to automatically direct the object into one of at least two paths according to its shape, said electronic processing means comprising means for deriving a signal representative of the approximation of the object to a spherical shape, means for deriving a signal representative of the approximation of the object to symmetry, and means for deriving a signal representative of reentrants in the object.

17. A method of sorting a succession of objects according to shape without centering the objects, comprising:

feeding along a direction of feed each successive object through a viewing zone at a rate of at least one per second;

electro-optically viewing the object to provide respective images of the object, as seen generally normal to said direction of feeding, at a number of different relative angular positions of the object about said direction;

electrically sensing substantially the whole of the profile of each of the images, and forming electrical signals corresponding to two-dimensional images of the object as electro-optically viewed;

automatically computing the shape of the object making use of information derived from sensing the edges of the iamges, to thereby derive a signal representative of the shape of the object; and automatically directing the object into one of at least two paths according to said signal representative of its shape.

18. A method of sorting a succession of objects according to shape, comprising:

feeding each successive object through a feeding zone at a rate of at least one per second;

illuminating the object as it passes through the viewing zone using illuminating means which illuminate simultaneously the whole of that surface which faces the illuminating means;

viewing the object as it passes through the viewing zone using at least four fixed electronic viewers spaced in one plane around the viewing zone;

deriving from each viewer signals representative of the edges of the object as viewed at a particular instant by all of the viewers;

digitizing the signals and processing the signals electronically to determine in which of at least two shape categories the object falls; and automatically directing the object into one of at least two paths according to its shape.

19. A method of sorting a succession of objects according to shape, comprising:

feeding each successive object through a feeding zone at a rate of at least one per second;

illuminating the object as it passes through the viewing zone, using illuminating means;

viewing the object as it passes through the viewing zone using at least four fixed electronic viewers spaced in one plane around the viewing zone, the viewers being arranged opposite respective illuminating means, whereby the images received by the viewers are of a dark object against a light field;

deriving from each viewer signals representative of the edges of the object as viewed at a particular instant by all the viewers;

processing the signals electronically to determine in which of at least two shape categories the object falls; and automatically directing the object into one of at least two paths according to its shape.

20. A method of sorting a succession of objects according to shape, comprising:

feeding each successive object through a feeding zone at a rate of at least one per second;

illuminating the object as it passes through the viewing zone using illuminating means which illiuminate simultaneously the whole of that surface which faces the illuminating means;

viewing the object as it passes through the viewing zone using at least four fixed electronic viewers spaced in one plane around the viewing zone, each viewer viewing substantially the whole of the profile of the object as presented to the viewer;

deriving from each viewer signals representative of substantially the whole of the profile of the object as viewed at a particular instant by all the viewers;

processing the signals electronically to determine in which of at least two shape categories the object falls; and automatically directing the object into one of at least two paths according to its shape.

21. A method of classifying a succession of objects according to shape, comprising:

feeding each successive object through a feeding zone at a rate of at least one per second;

illuminating the object as it passes through the viewing zone;

viewing the object as it passes through the viewing zone using at least four fixed electronic viewers spaced in one plane around the viewing zone, each viewer viewing substantially the whole of the profile of the object as presented to the viewer;

deriving from each viewer digital signals representative of substantially the whole of the profile of the objects as viewed at a particular instant by each respective viewer; and processing the digital signals electronically to determine in which of at least two classes the object falls.

22. Apparatus for sorting a rapid succession of objects according to shape, comprising:

a viewing zone through which each successive object will be fed;

means for illuminating the object as it passes through the viewing zone, the illuminating means illuminating simultaneously the whole of that surface of the object which faces the illuminating means;

at least four fixed electronic viewers spaced in one plane around the viewing zone, for viewing the object as it passes through the viewing zone;

means for deriving from each viewer signals representative of the edges of the object as viewed at a particular instant by all the viewers;

sorting means for directing the object into one of at least two paths;

means for normalizing and digitizing said signals to provide digital signals representative of the edges of the object as viewed by each respective viewer; and electronic processing means for processing said digital signals to determine in which of at least two shape categories the object falls, and for giving output signals to said sorting means for automatically directing the object into one of said at least two paths according to the shape of the object.

23. Apparatus for sorting a rapid succession of objects according to shape, comprising:

a viewing zone through which each successive object will be fed;

means for illuminating the object as it passes through the viewing zone, the illuminating means illuminating simultaneously the whole of that surface of the object which faces the illuminating means;

at least four fixed electronic viewers spaced in one plane around the viewing zone, for viewing the object as it passes through the viewing zone, each viewer viewing substantially the whole of the profile of the object as presented to the viewer;

means for deriving from each viewer signals representative of substantially the whole of the profile of the object as viewed at a particular instant by each respective viewer;

sorting means for directing the object into one of at least two paths; and electronic processing means for processing said signals to determine in which of at least two shape categories the object falls, and for giving output signals to said sorting means for automatically directing the object into one of said at least two paths according to the shape of the object.

24. Apparatus for sorting a rapid succession of objects according to shape, comprising:

a viewing zone through which each successive object will be fed;

means for illuminating the object as it passes through the viewing zone;

at least four fixed electronic viewers spaced in one plane around the viewing zone, for viewing the object as it passes through the viewing zone, the viewers being arranged opposite respective illuminating means, whereby the viewers view a dark object against a light field;

means for deriving from each viewer signals representative of the edges of the object as viewed at a particular instant by all the viewers;

sorting means for directing the object into one of at least two paths; and electronic processing means for processing said signals to determine in which of at least two shape categories the object falls, and for giving output signals to said sorting means for automatically directing the object into one of said at least two paths according to the shape of the object.

25. Apparatus for sorting a rapid succession of objects according to shape, compising;

a viewing zone through which each successive object will be fed;

means for illuminating the object as its passes through the viewing zone, the illuminating means illuminating simultaneously the whole of that surface of the object which faces the illuminating means;

a least four fixed electronic viewers spaced in one plane around the viewing zone, for viewing the object as it passes through the viewing zone, the viewers being arranged opposite the respective illuminating means, whereby the viewers view a dark object against a light field;

means for deriving from each viewer signals representative of the edges of the object as viewed at a particular instant by all the viewers;

sorting means for directing the object into one of at least two paths; and electronic processing means for processing said signals to determine in which of at least two shape categories the object falls, and for giving output signals to said sorting means for automatically directing the object into one of said at least two paths according to the shape of the object.

26. A method of sorting a succession of objects according to shape, comprising:

feeding each successive object through a feeding zone at a rate of at least one per second;

illuminating the object as it passes through the viewing zone to thereby generate a silhouette of the object;

viewing the silhouette of the object as the object passes through the viewing zone using at least four fixed electronic viewers spaced in one plane around the viewing zone;

deriving from each viewer signals representative of the edges of the object as viewed at a particular instant by all the viewers;

processing the signals electronically to determine in which of at least two shape categories the object falls; and automatically directing the object into one of at least two paths according to its shape.

27. The method of claim 26, wherein the viewers are equi-spaced through less than 180°, the angular distance between adjacent viewers being 180°0 divided by the number of viewers.

28. The method of claim 26, wherein the feeding of each successive object triggers a flash to illuminate the object.

29. A method of sorting a succession of objects according to shape without centering the objects, comprising:

feeding along a direction of feed each successive object through a viewing zone at a rate of at least one per second;

illuminating the object to provide a silhouette thereof;

electro-optically viewing the silhouette of the object to provide respective images of the silhouette of the object, as seen generally normal to said direction of feeding, at a number of different relative angular positions of the object about said direction;

electrically sensing the edges of the images and forming electrical signals correspondsing to two-dimensional images of the object as electro-optically viewed;

automatically computing the shape of the object making use of information derived from sensing the edges of the images, to thereby derive a signal representative of the shape of the object; and automatically directing the object into one of at least two paths according to said signal representative of its shape.

30. A method of sorting a succession of objects according to shape without centering the objects, comprising:

feeding along a direction of feed each successive object through a viewing zone at a rate of at least one per second;

electro-optically viewing the object to provide respective images of the object, as seen generally normal to said direction of feeding, at a number of different relative angular positions of the object about said direction;

electrically sensing the edges of the images and forming electrical signals corresponding to two-dimensional images of the object as electro-optically viewed;

normalizing and digitizing said electrical signals to form digital signals representative of the edges of the object as viewed by each respective viewer;

automatically computing the shape of the object making use of information derived from said digital signals, to thereby derive a signal representative of the shape of the object; and automatically directing the object into one of at least two paths according to said signal representative of its shape.

31. Apparatus for sorting a rapid succession of objects according to shape, comprising:

a viewing zone through which each successive object will be fed;

means for illuminating the object as it passes through the viewing zone, to thereby generate a silhouette of the object;

at least four fixed electronic viewers spaced in one plane around the viewing zone, each for viewing the respective silhouette of the object as the object passes through the viewing zone;

means for deriving from each viewer signals representative of the edges of the object as viewed at a particular instant by each respective viewer;

sorting means for directing the object into one of at least two paths; and electronic processing means for processing said signals to determine in which of at least two shape categories the object falls, and for giving output signals to said sorting means for automatically directing the object into one of said at least two paths according to the shape of the object.

32. Apparatus for sorting a rapid succession of objects according to shape, comprising:

a viewing zone through which each successive object will be fed;

means for illuminating the object as it passes through the viewing zone;

at least four fixed electronic viewers spaced in one plane around the viewing zone, for viewing the object as it passes through the viewing zone;

means for deriving from each viewer signals representative of the edges of the object as viewed at a particular instant by all the viewers;

sorting means for directing the object into one of at least two paths; and electronic processing means for normalizing and digitizing said signals to form digital signals and for processing said digital signals to determine in which of at least two shape categories the object falls, and for giving output signals to said sorting means for automatically directing the object into one of said at least two paths according to the shape of the object.

33. A method of classifying a succession of object according to shape, comprising:

feeding each successive object through a feeding zone at a rate of at least one per second;

illuminating the object as it passes through the viewing zone to thereby generate a silhouette of the object;

viewing the silhouette of the object as the object passes through the viewing zone using at least four fixed electronic viewers spaced in one plane around the viewing zone, each viewer viewing substantially the whole of the profile of the object as presented to the viewer;

deriving from each viewer signals representative of substantially the whole of the profile of the object as viewed at a particular instant by each respective viewer; and processing the signals electronically to determine in which of at least two classes the object falls.

34. A method of sorting a succession of objects according to shape, comprising:

feeding each successive object through a feeding zone at a rate of at least one per second;

illuminating the object as it passes through the viewing zone;

viewing the object as it passes through the viewing zone using at least four fixed electronic viewers spaced in one plane around the viewing zone;

deriving from each viewer signals representative of the edges of the object as viewed at a particular instant by all viewers;

normalizing and digitizing said signals to provide digital signals representative of the edges of the object as viewed by each respective viewer;

processing the digital signals electronically to determine in which of at least two shape categories the object falls; and automatically directing the object into one of at least two paths according to its shape.

* * * * *

UNITED STATES PATENT AND TRADEMARK OFFICE

CERTIFICATE OF CORRECTION

PATENT NO. : 4,946,045

DATED : August 7, 1990

INVENTOR(S) : Robert W. DITCHBURN, et al

It is certified that error appears in the above-identified patent and that said Letters Patent is hereby corrected as shown below:

Claim 17, line 18, (line 67 of column 6)
"lamges" should be --images--.

Claim 27, line 3, (line 1 of column 10)
"180° 0" should read --180°--.

Signed and Sealed this

Thirtieth Day of June, 1992

*Attest:*

DOUGLAS B. COMER

*Attesting Officer*

*Acting Commissioner of Patents and Trademarks*